US011590762B2

(12) United States Patent
Schalk et al.

(10) Patent No.: US 11,590,762 B2
(45) Date of Patent: Feb. 28, 2023

(54) RECIRCULATIONS USING TWO PUMPS

(71) Applicant: Hewlett-Packard Development Company, L.P., Spring, TX (US)

(72) Inventors: Wesley R. Schalk, Vancouver, WA (US); Kenneth Williams, Vancouver, WA (US); Christopher John Arnold, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/278,684

(22) PCT Filed: Dec. 4, 2018

(86) PCT No.: PCT/US2018/063735

§ 371 (c)(1),
(2) Date: Mar. 23, 2021

(87) PCT Pub. No.: WO2020/117206

PCT Pub. Date: Jun. 11, 2020

(65) Prior Publication Data

US 2022/0032645 A1 Feb. 3, 2022

(51) Int. Cl.
*B41J 2/18* (2006.01)
*B41J 2/175* (2006.01)

(52) U.S. Cl.
CPC ..... *B41J 2/18* (2013.01); *B41J 2/17506* (2013.01); *B41J 2/17596* (2013.01)

(58) Field of Classification Search
CPC .... B41J 2/175; B41J 2/17506; B41J 2/17593; B41J 2/17596; B41J 2/18
See application file for complete search history.

(56) References Cited

U.S. PATENT DOCUMENTS

| | | | | |
|---|---|---|---|---|
| 6,874,872 | B2 | 4/2005 | Lewis et al. | |
| 7,066,572 | B2 | 6/2006 | MeGarry et al. | |
| 7,901,063 | B2 | 3/2011 | Wouters et al. | |
| 9,524,132 | B2 | 12/2016 | Weaver et al. | |
| 9,616,674 | B2 | 4/2017 | De Saint Romain | |
| 9,694,590 | B2 | 7/2017 | Tomlin et al. | |
| 11,267,254 | B2 * | 3/2022 | Sauer | B41J 29/38 |
| 2005/0035985 | A1 | 2/2005 | Taguchi et al. | |
| 2009/0160887 | A1 | 6/2009 | Hamazaki et al. | |
| 2011/0025759 | A1 | 2/2011 | Rosati et al. | |
| 2011/0279558 | A1 | 11/2011 | Hibbard et al. | |
| 2012/0033019 | A1 | 2/2012 | Nitta | |
| 2012/0044292 | A1 | 2/2012 | Helsel et al. | |
| 2021/0260888 | A1 | 8/2021 | Sauer et al. | |

FOREIGN PATENT DOCUMENTS

| | | |
|---|---|---|
| EP | 2905142 | 8/2015 |
| EP | 3293004 | 3/2018 |
| KR | 20110061764 A | 6/2011 |
| WO | WO-2015030735 A1 | 3/2015 |

* cited by examiner

*Primary Examiner* — An H Do
(74) *Attorney, Agent, or Firm* — Brooks, Cameron & Huebsch, PLLC

(57) ABSTRACT

A method of recirculating printing fluid that includes with a first pump upstream of an internal reservoir, pumping printing fluid into the reservoir and with a second pump downstream of the internal reservoir and upstream of a pen assembly, pumping printing fluid from the reservoir.

15 Claims, 3 Drawing Sheets

RECIRCULATIONS USING TWO PUMPS

BACKGROUND

Printing includes the application of a print fluid to the surface of a media or other surface. In the context of a two-dimensional (2D) printing device, a layer of print fluid may be applied to the media in order to form any image thereon. In the context of a three-dimensional (3D) printing device, a plurality of layers of print fluid are applied to either the surface of a media or a build platform in order to form a 3D image or object.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
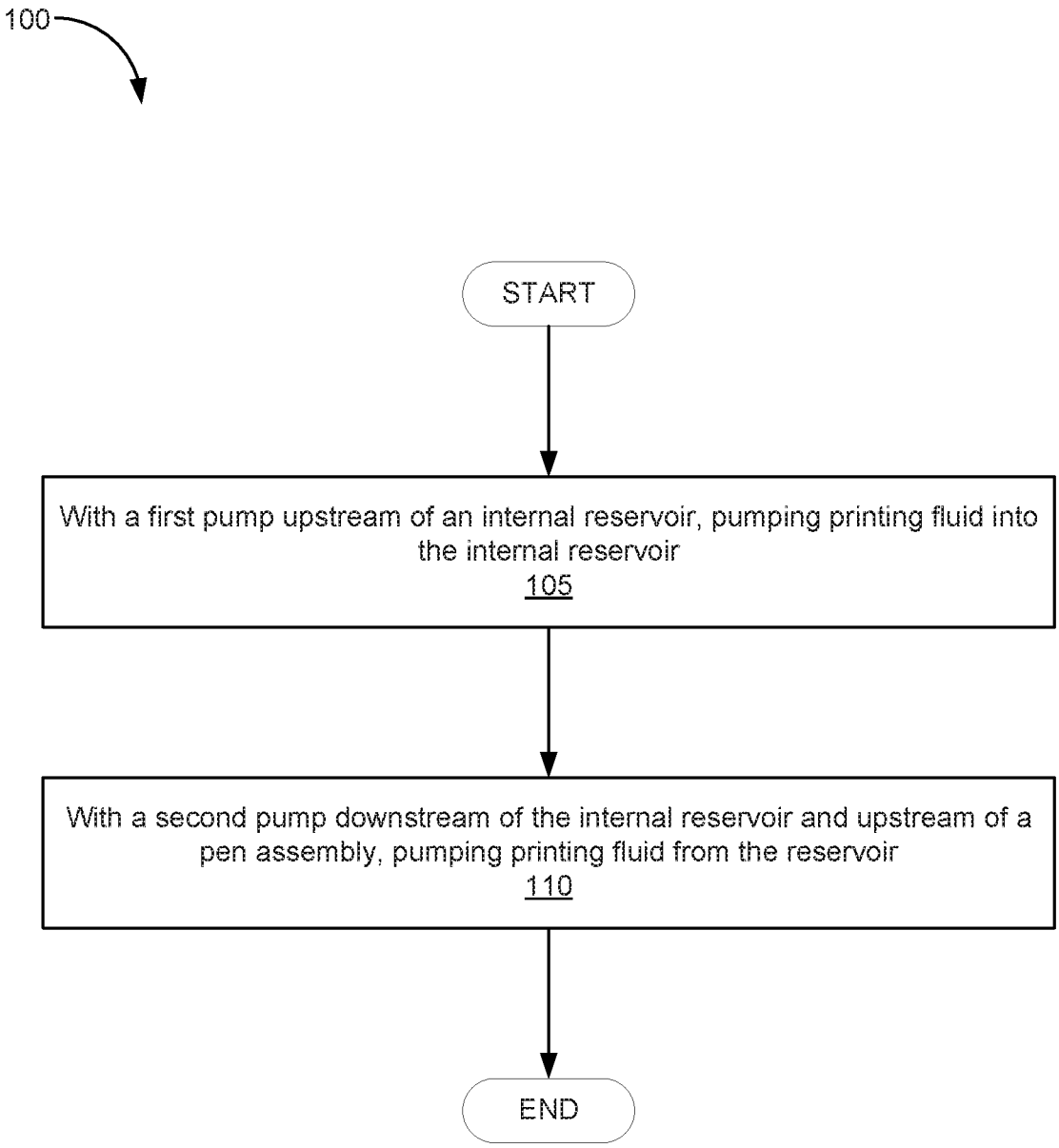
FIG. 1 is a flowchart depicting a method of recirculating printing fluid according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Printing devices may use a print material that is fluidic in nature. That is, the print material (as called print fluid herein) may be a substance that continually deforms (i.e., flows) under an applied shear stress. This allows the transport of the print fluid to be transported from a reservoir to a print head so that the print fluid may be ejected from the print head.

In some instances, however, the printing device may not be used for a period of time such as over holiday breaks. Over time, print fluids may lose aspects of their chemical makeup including evaporation of water. Additionally, during this time the particulate matter within the printing fluid may settle. Settling of this particular matter within the printing fluid may damage the parts of the printing device specifically the pen assembly and its subparts. Not only will a relatively thicker print fluid cause damage to the parts of the printing device, the loss of water due to evaporation may not be constant across the different parts within the printing device. Indeed, water may evaporate from, for example, hoses, tubing, or other fluidic channels within the printing device relatively faster than those locations were relatively larger amounts of printing fluid is maintained.

In order to prevent this damage from occurring to the printing device, the printing fluid may be subjected to a mixing process and/or recirculation process. Recirculating print substance within the printing device prior to transport of that printing fluid to the pen assembly will reduce concentration of particulate matter in components with relatively higher rate of water loss. Additionally, mixing fresh printing fluid with aged or depleted printing fluid may improve the quality of the printing fluid. The reliability of the printing device and print quality resulting therefrom may depend on the quality of printing fluid delivered to the pen assembly. In certain printing devices that implement continuous printing fluid supply systems, any reservoirs may be refilled using printing fluid supplies. During refill of the reservoirs or over specific time intervals, mixing of the printing fluid within the reservoir may improve the quality of the printing fluid. By recirculating the printing fluid and, thereby, mixing the various components of the printing fluid together again with itself and/or newly introduced printing fluid will prevent damage to the printing device and, accordingly, also increase quality of the printed materials. By preventing damage to the printing device, servicing costs may be reduced and productivity associated with the use of the printing device may be increased.

The present specification describes a method of recirculating printing fluid that includes with a first pump upstream of an internal reservoir, pumping printing fluid into the reservoir and with a second pump downstream of the internal reservoir and upstream of a pen assembly, pumping printing fluid from the reservoir.

The present specification further describes a printing device that includes an internal reservoir; a first pump fluidically coupled to and upstream of the internal reservoir; a second pump downstream of the internal reservoir and upstream of a pen assembly; and a recirculation module to selectively activate the first and second pump to recirculate an amount of printing fluid through the internal reservoir.

The present specification also describes a non-transitory computer readable storage medium comprising computer usable program code embodied therewith, the computer usable program code to, when executed by a processor: execute a recirculation module to activate a first pump upstream of an internal reservoir to pump printing fluid into the reservoir and activate a second pump downstream of the internal reservoir and upstream of a pen assembly to pump printing fluid from the reservoir.

As used in the present specification and in the appended claims, the term "printing fluid" is meant to be understood as any print material that includes a fluid carrier to convey a print material to a media or build platform. The examples presented herein include those print fluids that are used in connection with two-dimensional printing devices as well as three-dimensional printing devices.

Turning now to the figures, FIG. 1 is a flowchart depicting a method (100) of recirculating printing fluid according to an example of the principles described herein. The method (100) may include, with a first pump placed upstream of an internal reservoir, pumping (105) a printing fluid into the internal reservoir. In the examples presented herein, the printing device may include an internal reservoir that provides to a pen assembly or plurality of pen assemblies any amount and type of printing fluid. In this example, the internal reservoir may be fluidically coupled to a fluid supply port via the first pump. During certain operations of the printing device, the first pump may pump, from a fluidically coupled fluid supply, an amount of printing fluid into the internal reservoir. During this refill process, certain signals may be presented to a processor of the printing device that cause the first pump to pump any amount of printing fluid form the fluid supply to the internal reservoir. In an example, fluid level gauges may be used with the internal reservoir to provide to the processor data descriptive of the amount of fluid that may be pumped from the fluid supply.

The internal reservoir may be any size and number of internal reservoirs. In an example, the number of reservoirs may match the number of colors and/or types of printing fluid used by the printing device. In a specific example, the printing device may operate to dispense cyan, magenta, yellow, and black colored printing fluids and, as a result, four internal reservoirs may be included within the printing device. In any example, a fluid supply containing any of these colors and/or types of may be coupled to a fluid port upstream of the first pump at any time in order to provide any amount of fluid into the internal reservoirs.

In an example, the internal reservoir may include a printing fluid level gauge. The printing fluid level gauge may detect an amount of printing fluid within the internal reservoir and report the amount of printing fluid to a user via, for example, a user interface associated with the printing device. Associated with the internal reservoir may be a vent to allow the pressure within the internal reservoir to be maintained at a consistent pressure.

The method (100) may also include with a second pump downstream of the internal reservoir and upstream of a pen assembly, pumping (110) printing fluid from the reservoir. In this example, the second pump may serve a first purpose, a second purpose, or a combination of both. The first purpose may include pumping (110) printing fluid from the reservoir to a pen assembly in order to 1) provide printing fluid to the pen assembly and 2) recirculate printing through a portion of the pen assembly. The second purpose includes recirculating the printing fluid through a printing fluid bypass that allows the second pump to pump (110) the printing fluid out of the reservoir and back into the reservoir. In this example, the second pump pumps (110) the fluid from one side of the reservoir and back into a second side of the reservoir opposite the first side. In any example presented herein, the recirculation of the fluid back into the reservoir may be at any side of the reservoir. In any example presented herein, the second pump may be used to recirculate the printing fluid from the reservoir and throughout the printing device when a fluid supply is coupled to the printing device and/or when it is not coupled to the printing device.

In a specific example, the second pump may be activated during a printing process. The printing process may include the activation of a pen assembly downstream of the second pump and the internal reservoir. Thus, in an example presented herein, the method (100) of recirculating printing fluid described herein, may also be conducted during a printing process. This may allow for the continuous recirculation of the printing fluid within the printing device in order to provide the highest quality of printing fluid to the pen assembly thereby reducing the possibility of damage to the pen assembly.

In any example presented herein and regardless of the coupled state of a fluid supply to the printing device, the printing device may initiate the method (100) of recirculating the printing fluid after a set length of time has passed. The interval of time may be set to any length of time and may be based on a number or combination of factors including, but not limited to, the type of printing fluid within the printing device, the number of times the printing device has been resupplied using the fluid supply, the time that has passed since a last resupply from the fluid supply, the time that has passed since a printing process has occurred, the time that has passed since the pen assembly has ejected fluid, the humidity ambient to the printing device, the temperature ambient to the printing device, the temperature of the printing device, the amount of fluid within the internal reservoir, and the amount of fluid within any fluidic channels within the printing device, among other factors. In an example, the printing device may be communicatively coupled to a weather forecast database that provides the printing device with past, present, and/or future data regarding the weather conditions in the area. Based on this data, the printing device may access a look-up table that determines, based on the weather around the printing device, when to conduct the method (100) of recirculating the printing fluid.

Figure 2:
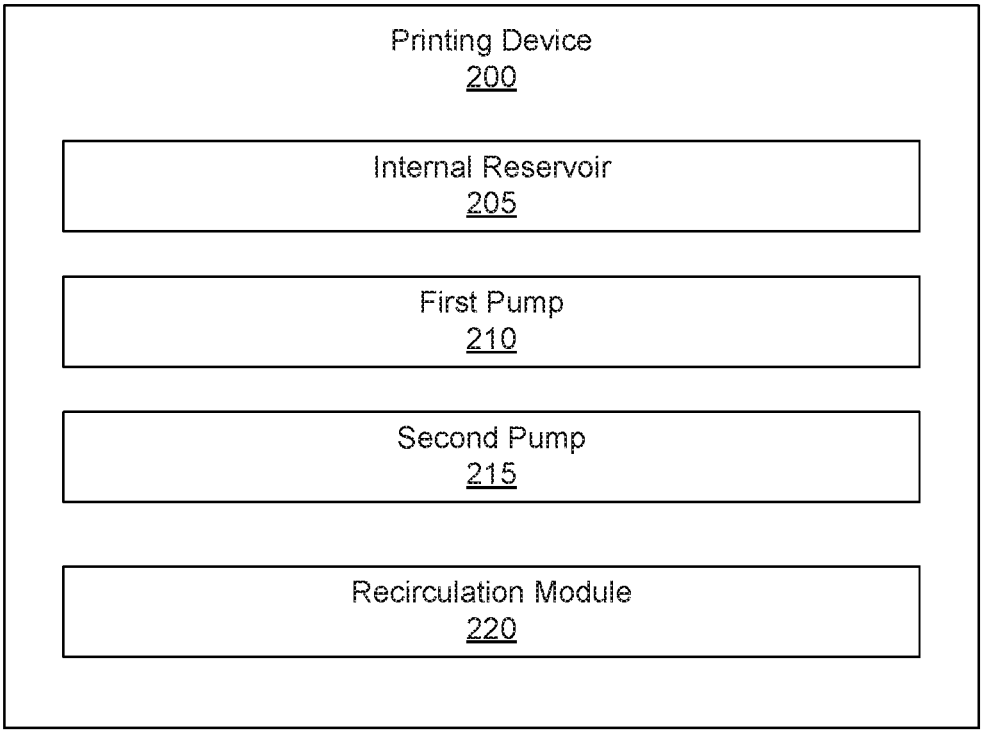
FIG. 2 is a block diagram of a printing device according to an example of the principles described herein.

FIG. 2 is a block diagram of a printing device (200) according to an example of the principles described herein. The printing device (200) may include an internal reservoir (205) fluidically coupled to a first pump (210) and a second pump (215) upstream and downstream of the internal reservoir (205), respectively. The internal reservoir (205) may be any reservoir that may maintain any amount of fluid within the printing device (200) in order to supply a pen assembly with an amount of printing fluid via the second pump (215) and any fluid channels formed between these elements. In an example, the internal reservoir (205) may be resupplied with printing fluid using the first pump (210) and a print supply fluidically coupled to the internal reservoir (205) via the first pump (210). In this example, a processor associated with the printing device (200) may detect the presence of the fluid supply and causes signals to be sent to the first pump (210) to start pumping an amount of fluid into the internal reservoir (205).

In an example, as the first pump (210) begins to pump fluid from the fluid supply, the processor may concurrently send signals to the second pump (215) to cause the second pump (215) to start to pump printing fluid out of the internal reservoir (205) as well. In this example, the second pump (215) may pump printing fluid out of the internal reservoir (205) and to a pen assembly in order to recirculate an amount of fluid maintained at and/or within any portion of the pen assembly. In an example, the second pump (215) may pump printing fluid out of the internal reservoir (205) and through a by-pass line so as to pull printing fluid out of the internal reservoir (205) and back into the internal reservoir (205). This allows the printing fluid within the internal reservoir (205) to be mixed. In yet another example, the second pump (215) may pump printing fluid both through the portions of the pen assembly and the by-pass line in order to concurrently recirculate through the pen assembly and within the internal reservoir (205). In any example presented herein, any recirculation of any printing fluid may be initiated upon detection of the fluid supply upstream of the first pump (210).

In an example, as the first pump (210) and second pump (215) may be activated once the first pump (210) is pumping printing fluid into the internal reservoir (205). In this example, the influx of printing fluid into the internal reservoir (205) via both the new fluid from the fluid supply and the by-pass line recirculates the printing fluid within the printing device.

The pen assembly fluidically coupled to the second pump (215) may be any type of device that receives an amount of printing fluid and ejects the printing fluid onto a media or a build platform as described herein. In a specific example, the pen assembly may include a plurality of firing chambers fluidically coupled to a plurality of nozzles through which the printing fluid is ejected. In an example, the fluid chambers may include some ejection device such as a piezoelectric device or thermosensitive device so that, upon activation, an amount of printing fluid is ejected out of the nozzles.

As described, the printing device (200) may include a processor. The processor may execute computer readable program code in order to affect the processes and functionalities of the printing device (200) and method (100) described herein. Additionally, in order to achieve its described functionality, the printing device (200) may include various hardware components. Among these hardware components may be the number of processors, a number of data storage devices, a number of peripheral device adapters, and a number of network adapters. These hardware components may be interconnected through the use of a number of busses and/or network connections. In one example, the processor, data storage device, peripheral device adapters, and the network adapter may be communicatively coupled via a bus.

The processor may include the hardware architecture to retrieve executable code from the data storage device and execute the executable code. The executable code may, when executed by the processor, cause the processor to implement the functionality of, with a first pump upstream of an internal reservoir, pumping printing fluid into the internal reservoir; and with a second pump downstream of the internal reservoir and upstream of a pen assembly, pumping printing fluid from the reservoir according to the methods of the present specification described herein. In the course of executing code, the processor may receive input from and provide output to a number of the remaining hardware units.

The data storage device may store data such as executable program code that is executed by the processor or other processing device. As will be discussed, the data storage device may specifically store computer code representing a number of applications that the processor executes to implement the functionality described herein.

The data storage device may include various types of memory modules, including volatile and nonvolatile memory. For example, the data storage device of the present example includes Random Access Memory (RAM), Read Only Memory (ROM), and Hard Disk Drive (HDD) memory. Many other types of memory may also be utilized, and the present specification contemplates the use of many varying type(s) of memory in the data storage device as may suit a particular application of the principles described herein. In certain examples, different types of memory in the data storage device may be used for different data storage needs. For example, in certain examples the processor may boot from Read Only Memory (ROM), maintain nonvolatile storage in the Hard Disk Drive (HDD) memory, and execute program code stored in Random Access Memory (RAM).

The data storage device may comprise a computer readable medium, a computer readable storage medium, or a non-transitory computer readable medium, among others. For example, the data storage device may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The hardware adapters in the printing device (200) enable the processor to interface with various other hardware elements, external and internal to the printing device (200). For example, the peripheral device adapters may provide an interface to input/output devices, such as, for example, display device, a mouse, or a keyboard. The peripheral device adapters may also provide access to other external devices such as an external storage device, a number of network devices such as, for example, servers, switches, and routers, client devices, other types of computing devices, and combinations thereof. The display device may be provided to allow a user of the printing device (200) to interact with and implement the functionality of the printing device (200) described herein. The peripheral device adapters may also create an interface between the processor and the display device or other media output devices. The network adapter may provide an interface to other computing devices within, for example, a network, thereby enabling the transmission of data between the printing device (200) and other devices located within the network such as weather databases as described herein.

The printing device (200) may further include a recirculation module (220). The recirculation module (220) may be, in an example, computer readable program code that, when executed by a processor of the printing device (200), selectively activates the first pump (210) and/or second pump (215) in order to recirculate an amount of printing fluid through the internal reservoir (205). In an example, the recirculation module (220) may be in the form of an application specific integrated circuit (ASIC). In this example, a processor of the printing device (200) may access the recirculation module (220) in order to execute the functionalities and methods described herein.

As described herein, the recirculation module (220) and/or processor may detect the presence of a fluid supply at a fluid supply port of the printing device (200). In any example, the fluid supply and printing device (200) may transfer data between them in order to detect the amount of fluid in the fluid supply, the type and/or color of the fluid supply, the age of the fluid within the fluid supply, as well as other types of information and data. Once such data is received by the processor of the printing device (200), the printing device (200) may access a look-up table in order to determine when a recirculation process should be initiated. As described herein, the recirculation methods may be initiated upon detection of the fluid supply at the port. In another example, the recirculation process may be initiated at a certain set of time intervals based on one of a plurality of criteria as described herein. Example criteria may include the humidity around the printing device (200) over time, the temperature around the printing device (200) over time, predicted humidity and/or temperature values around the printing device (200) over time, the time that has passed since a last print job was completed, among other criteria that may affect the printing fluid maintained with the internal reservoir (205) or any other part of the printing device (200). Indeed, the processor of the printing device (200) may access a look-up table that defines when to initiate a recirculation process based on a predicted amount of water or other fluid carrier has evaporated from any printing fluid. The data on the look-up table may also take into consideration the amounts of printing fluid maintained in any portion of the printing device (200) because smaller volumes (i.e., printing fluid maintained in fluidic channels) of printing fluid may have an increase in evaporation as compared to relatively larger volumes of printing fluid (i.e., the printing fluid within the internal reservoir (205)). In an example, the processor of the printing device (200) may initiate a recirculation process after each print job is complete or after or concurrently with the activation of the pen assembly.

During execution of the recirculation module (220) the printing fluid may be recirculated out of and into the internal reservoir (205) using a recirculation path. The recirculation path may consist of the first pump (210) and/or the second pump (215) with any number of fluidic channels fluidically coupling the internal reservoir (205) to the pumps (210, 215).

The systems and methods described herein may be initiated via the use of a non-transitory computer readable storage medium that includes computer usable program code embodied therewith. In this example, the computer usable program code, when executed by a processor, may execute a recirculation module to activate a first pump upstream of an internal reservoir to pump printing fluid into the reservoir and activate a second pump downstream of the internal reservoir and upstream of a pen assembly to pump printing fluid from the reservoir. In any of these examples, the execution of the computer usable program code may cause the recirculation of any printing fluid at any time as described herein.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general-purpose computer, special purpose computer, or other programmable data processing apparatus to produce a machine, such that the computer usable program code, when executed via, for example, the processor of the printing device (200) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

Figure 3:
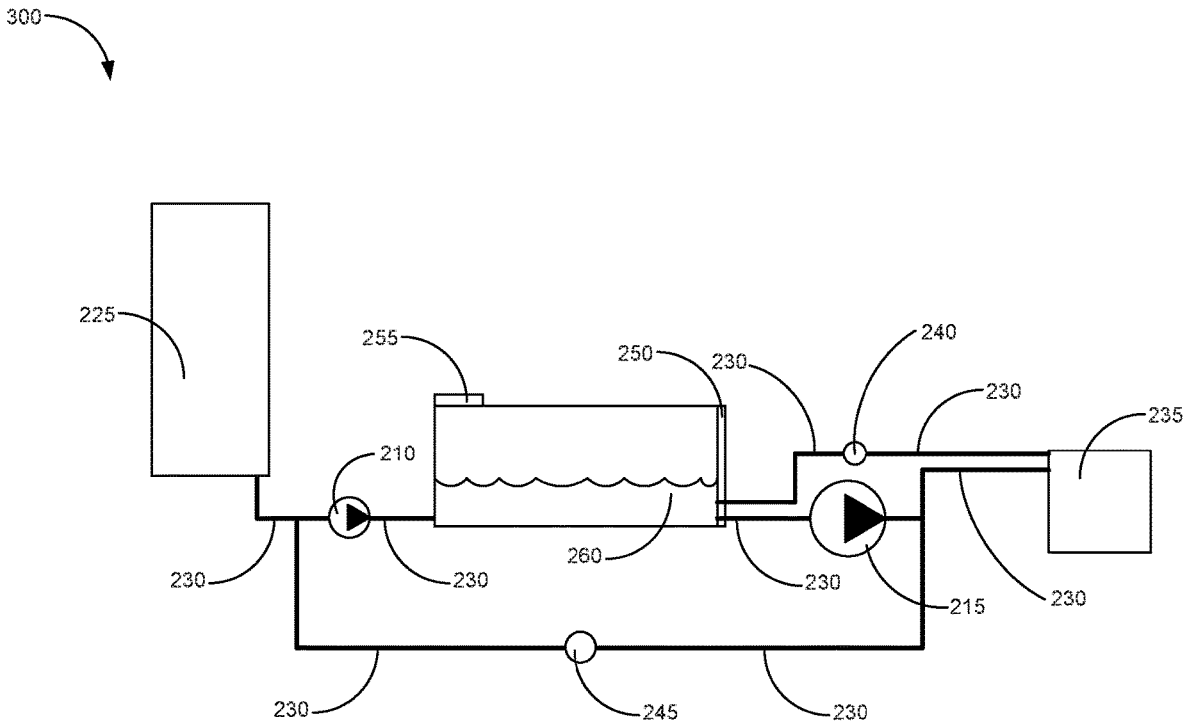
FIG. 3 is a schematic drawing of a printing device according to an example of the principles described herein.

FIG. 3 is a schematic drawing of a printing device (300) according to an example of the principles described herein. Although FIG. 3 shows a specific example and layout of the elements described herein, the present specification contemplates that the elements may be presented in other locations respective of each other.

The printing device (300) may include an internal reservoir (205) to maintain any amount of printing fluid (260) therein. A first pump (210) may be upstream of the internal reservoir (205) and a second pump (215) may be placed downstream of the internal reservoir (205). Additionally, the first pump (210) may be placed between the internal reservoir (205) and a fluid supply (225). A series of fluidic channels (230) may fluidically couple the fluid supply (225) to the first pump (210) and the first pump (210) to the internal reservoir (205). Similarly, a series of fluidic channels (230) may fluidically couple the internal reservoir (205) to the second pump (215), the second pump (215) to a pen assembly (235), and from the pen assembly (235) to a pressure control device (PCD) (240), and from the PCD (240) to the internal reservoir (205).

In any example, the printing device (300) may include a series of fluidic channels (230) that couple the internal reservoir (205) to a fluid bypass valve (245). These fluidic channels (230) and fluid bypass valve (245) may define a fluid bypass as described herein that allows for a recirculation of printing fluid out of and back into the internal reservoir (205). In this example, a processor of the printing device (300) may open the fluid bypass valve (245) and activate the second pump (215) so as to create the recirculation of the printing fluid out of and back into the internal reservoir (205). As depicted in FIG. 3, the printing fluid may be recirculated from a first side of the internal reservoir (205) and back into a second side of the internal reservoir (205) opposite the first side. In any example, the recirculation of the fluid may occur by pumping the fluid out of any side of the reservoir and back into any side of the reservoir. This recirculation of the fluid may cause the unsettling of any particulate matter within the printing fluid so as to maintain a consistent composition of the printing fluid after an initiation of the recirculation process. In any example, presented herein, the fluid may be pumped from and back into the reservoir using the first pump (215), the second pump (210), or a combination of both the first pump (210) and second pump (215) cooperating to pass the fluid out of and into the reservoir. In any example presented herein, the processor may coordinate the activation of the first pump (210) and second pump (215) as well as their respective pumping rates based on their individual pumping capabilities.

The printing device (200) may further include a fluid level gauge (250). The fluid level gauge (250) may detect a level of printing fluid within the internal reservoir (205) and, based on the detected level of printing fluid, cause a printing fluid from the fluid supply (225) to be transferred to the internal reservoir (205) via the first pump (210) and fluidic channels (230). The readings from the fluid level gauge (250) may also be used to determine when to initiate a recirculation process at any location within the printing device (200) as described herein.

The printing device (300) may also include a vent (255). The vent (255) may allow any amount of air to escape or enter the internal reservoir (205) when the level of printing fluid changes within the internal reservoir (205) or when the pressure within the internal reservoir (205) changes due to temperature changes or external ambient pressures.

In an example, the printing device (300) may include a temperature sensor and humidity sensor. As described herein, the data obtained by the temperature and humidity sensors may be used to calculate when to initiate a recirculation process.

The specification and figures describe a recirculation method and systems described herein may prevent damage of the printing device by recirculating printing fluid throughout the printing device using the two pumps described herein. Additionally, through the use of the two pumps, the printing fluid may be recirculated at locations upstream and/or downstream of an internal reservoir. The recirculation process may be initiated at certain times such as the passage of time, the detection of a fluid supply at the printing device, and/or the actuation of a pen assembly. Criteria such as humidity and temperature may also be taken into consideration in order to recirculate the printing fluid at any location within the printing device.

The preceding description has been presented to illustrate and describe examples of the principles described. This description is not intended to be exhaustive or to limit these principles to any precise form disclosed. Many modifications and variations are possible in light of the above teaching.

What is claimed is:

1. A method of recirculating printing fluid, comprising:

with a first pump upstream of an internal reservoir, pumping printing fluid into the internal reservoir; and with a second pump downstream of the internal reservoir and upstream of a pen assembly, pumping printing fluid from the reservoir.

2. The method of claim 1, wherein the first pump pulls printing fluid from a print supply fluidically coupled upstream of the internal reservoir.

3. The method of claim 1, wherein the first pump pumps printing fluid from a recirculation path fluidically coupling the internal reservoir, the second pump, and the first pump together.

4. The method of claim 1, wherein the second pump is activated during a refill process, the refill process comprising activating the first pump to pump an amount of printing fluid from a print supply fluidically coupled upstream of the internal reservoir and first pump.

5. The method of claim 4, wherein the refill process comprises detecting the presence of the print supply upstream of the first pump.

6. The method of claim 1, wherein pumping fluid from the internal reservoir may include pumping fluid back into the internal reservoir as a recirculation process, wherein the recirculation process of the printing fluid is conducted by the first pump, the second pump, or combinations thereof and wherein the recirculation process occurs at a predetermined length of time.

7. A printing device, comprising:

an internal reservoir;

a first pump fluidically coupled to and upstream of the internal reservoir;

a second pump downstream of the internal reservoir and upstream of a pen assembly; and a recirculation module to selectively activate the first and second pump to recirculate an amount of printing fluid through the internal reservoir.

8. The printing device of claim 7, wherein the recirculation module detects whether a fluid supply is fluidically coupled to the first pump upstream of the first pump and internal reservoir.

9. The printing device of claim 8, wherein, upon detection of the fluid supply, initiating a recirculation process simultaneously with a refill process.

10. The printing device of claim 9, wherein the recirculation process comprises a recirculation of the pen assembly, a recirculation of the internal reservoir, or combinations thereof.

11. The printing device of claim 8, wherein the recirculation module detects when the pen assembly is activated and conducts a recirculation process.

12. A non-transitory computer readable storage medium comprising computer usable program code embodied therewith, the computer usable program code to, when executed by a processor:

execute a recirculation module to:

activate a first pump upstream of an internal reservoir to pump printing fluid into the reservoir; and activate a second pump downstream of the internal reservoir and upstream of a pen assembly to pump printing fluid from the reservoir.

13. The non-transitory computer readable storage medium of claim 12, wherein the first pump pulls printing fluid from a print supply fluidically coupled upstream of the internal reservoir.

14. The non-transitory computer readable storage medium of claim 12, wherein the first pump pumps printing fluid from a recirculation tube fluidically coupling the internal reservoir, the second pump, and the first pump together.

15. The non-transitory computer readable storage medium of claim 12, wherein the second pump is activated during a refill process, the refill process comprising activating the first pump to pump an amount of printing fluid from a print supply fluidically coupled upstream of the internal reservoir and first pump.

* * * * *